US009079641B2

(12) United States Patent
Imel et al.

(10) Patent No.: US 9,079,641 B2
(45) Date of Patent: Jul. 14, 2015

(54) FLOATING DOCK SYSTEM

(71) Applicant: E-Z-DOCK, INC., Monett, MO (US)

(72) Inventors: Dustin Imel, Rocky Comfort, MO (US); Curtis Downs, Denver, NC (US); Dan Guthrie, Mooresville, NC (US)

(73) Assignee: E-Z-DOCK, INC., Monett, MO (US)

( * ) Notice: Subject to any disclaimer, the term of this patent is extended or adjusted under 35 U.S.C. 154(b) by 295 days.

(21) Appl. No.: 13/711,339

(22) Filed: Dec. 11, 2012

(65) Prior Publication Data

US 2013/0152844 A1 Jun. 20, 2013

Related U.S. Application Data

(60) Provisional application No. 61/570,519, filed on Dec. 14, 2011.

(51) Int. Cl.

| | |
|---|---|
| ***B63B 35/44*** | (2006.01) |
| ***B25G 3/08*** | (2006.01) |
| ***B63B 38/00*** | (2006.01) |
| ***B63B 3/08*** | (2006.01) |
| ***B63B 35/38*** | (2006.01) |

(Continued)

(52) U.S. Cl.

CPC . *B63B 38/00* (2013.01); *B63B 3/08* (2013.01); *B63B 35/38* (2013.01); *B63B 2241/10* (2013.01); *B63C 1/02* (2013.01); *B63C 1/06* (2013.01)

(58) Field of Classification Search

CPC ..... B63C 1/02; B63C 1/06
USPC ..... 114/264, 362, 45, 46; 403/331, 381; 52/586.2

See application file for complete search history.

(56) References Cited

U.S. PATENT DOCUMENTS 4,018,179 A * 4/1977 Rutter ..... 114/45
4,474,504 A 10/1984 Whitman et al.

(Continued)

FOREIGN PATENT DOCUMENTS

WO 9914110 A1 3/1999

OTHER PUBLICATIONS

PCT Notification dated Jun. 26, 2014—PCT/US2012/023716—International Preliminary Report on Patentability , 5 pgs.

(Continued)

*Primary Examiner* — S. Joseph Morano
*Assistant Examiner* — Andrew Polay
(74) *Attorney, Agent, or Firm* — Polster, Lieder, Woodruff & Luccesi, L.C.

(57) ABSTRACT

A connector for a assembling members of a floating dock system comprises at least one post and a brace extending from the post. The post is shaped generally complimentarily to the shape of the socket, and comprises a generally convex mid-section connected between a pair of generally falcate end portions. The post and brace define a flat, generally horizontal top surface to the connector.

The dock system also includes a supplemental floatation system having a hollow floatation member body defining a chamber. The body includes a water port positioned to place the body interior in communication with water. An air port positioned vertically above the water port is placed in communication with a pump. A valve can be positioned between the chamber and the pump to selectively place the chamber in communication with the pump or to place the chamber in communication with the atmosphere.

21 Claims, 15 Drawing Sheets

(51) Int. Cl.
*B63C 1/02* (2006.01)
*B63C 1/06* (2006.01)

(56) References Cited

U.S. PATENT DOCUMENTS

| | | | | |
|---|---|---|---|---|
| 5,281,055 | A | 1/1994 | Neitzke et al. | |
| 5,931,113 | A | 8/1999 | Eva, III et al. | |
| 5,941,660 | A | 8/1999 | Rueckert | |
| 6,073,572 | A | 6/2000 | Gruhn et al. | |
| 6,179,525 | B1 * | 1/2001 | Gruhn et al. | 405/219 |
| 6,526,902 | B1 | 3/2003 | Faber | |
| 7,069,872 | B2 | 7/2006 | Ostreng et al. | |
| 7,225,751 | B2 | 6/2007 | Rueckert | |
| 8,905,670 | B1 * | 12/2014 | Blakeman | 403/381 |
| 2005/0172876 | A1 | 8/2005 | Ostreng | |
| 2006/0272566 | A1 * | 12/2006 | Rueckert | 114/263 |
| 2009/0120344 | A1 | 5/2009 | Dickman | |

OTHER PUBLICATIONS

International Search Report from corresponding International Application No. PCT/US2012/023716.

International Written Opinion from corresponding International Application No. PCT/US2012/023716.

* cited by examiner

FLOATING DOCK SYSTEM

CROSS-REFERENCE TO RELATED APPLICATIONS

This application claims priority to U.S. App. No. 61/570,519 filed Dec. 14, 2011.

STATEMENT REGARDING FEDERALLY SPONSORED RESEARCH OR DEVELOPMENT

Not Applicable.

BACKGROUND

This application relates to a floating dock system comprised of dock members, such as drive-on watercraft lifts, floating dock segments, and the like, and, in particular, to a connector for assembling floating dock members into a floating dock system, and a supplemental floatation member for watercraft lifts.

Floating dock systems are made from selected dock members (such as rectilinear sections and watercraft lifts) which are assembled together by connectors. The rectilinear sections can be used to form deck areas, piers and the like, and the watercraft lifts can be connected to the formed deck areas, piers, etc. Over the years, many different types of connectors have been developed and used. Some require the connector, or a portion of the connector, be installed from below the dock section. It would be desirable to provide a connector which is easy to install.

Watercraft lifts can receive small personal watercraft (or PWCs), such as are sold under the name SeaDoo® and WaveRunner®, or larger watercraft (for example, watercraft weighing up to 4500 lbs.). Larger watercraft typically have larger engines, and hence the rear of the watercraft is heavy. With a typical watercraft lift, the heavy back end of the watercraft may be heavy enough, such that the natural buoyancy of the watercraft lift does not raise the back end of the watercraft out of the water, as is desirable.

BRIEF SUMMARY

Briefly stated, a floating dock system comprises a first dock member having an upper surface, a bottom surface, a front wall, a rear wall, and side walls. At least one connector receiving socket is formed in at least one of the walls and comprises a socket main portion spaced inwardly from the wall of the body and a socket entrance portion extending from the wall to the socket main portion. The socket main portion and the socket entrance portion both open at the bottom of the body. The socket main portion is defined by a back wall, opposed side walls, and a front surface; and the socket entrance portion opens into the front surface of the socket main portion and is defined by side walls. The socket main portion has a side-to-side width greater than the side-to-side width of the entrance portion.

A connecter is provided to connect the dock member to another dock member or to mount an accessory to the dock member. The connector comprises at least one post and a brace extending from the post. The post has a side-to-side width greater than the side-to-side width of the brace, and is sized to be received in the connector socket main portion. The connector brace has a side-to-side width sized to extend through the connector socket entrance portion, such that when the connector is received in the socket, the connector post engages the front surface of the socket main portion to prevent the connector from being pulled horizontally from the connector receiving socket.

In accordance with one aspect of the connector, the at least one post of the connector comprises a generally convex mid-section connected between a pair of generally curved, handle-bar-shaped or falcate end portions. The falcate end portions are generally symmetrical about a vertical plane extending the length of the at least one post through the center of the at least one post.

In accordance with another aspect of the connector, the connector has a generally rectangular prism shape and a height substantially equal to the height of the post, such that the connector defines a generally flat upper surface.

In accordance with a further aspect of the connector, the connector includes a flange extending outwardly from the base of the at least one post and the brace. The flange has a dimension (such as a side-to-side dimension) greater than a corresponding dimension of the opening in the connector receiving socket in the bottom of the dock member. Thus, the flange will engage the bottom of the dock member when the connector is placed in the connector receiving socket of the dock member.

In accordance with another aspect of the connector, the connector comprises two posts, with the first and second posts being on opposite sides of the brace. In this embodiment of the connector, the brace has a length, such that when the first post is received in the socket main portion, the second post is spaced from the wall of the first dock member, to facilitate connecting of a second dock member to the first dock member. The two posts can be identical, such that the connector has an axis of symmetry extending through the brace.

In another embodiment of the connector, the connector has an end wall on the brace which is opposite or spaced from the post. In this embodiment, the connector includes an accessory mounted to the end wall of the brace. The accessory can be a guide post which is generally S-shaped and pivotal relative to the connector.

In accordance with an aspect of the dock system, the dock system includes a second dock member. The second dock member comprises an upper surface, a bottom surface, a front wall, a rear wall, and side walls, with at least one connector receiving socket formed in at least one of the walls. The connector receiving socket is substantially identical to the connector receiving socket of the first dock member. The connector receiving sockets of the first and second dock members are positioned on the walls of the first and second dock members, such that, when the first and second dock members are positioned adjacent each other, the connector receiving socket of the second dock member is aligned with the connector receiving socket of the first dock member. This second dock member can have a side-to-side width which is less than a side-to-side width of the first dock member.

The dock member can be provided with a supplemental floatation system. The floatation system includes a floatation member which is securable to the bottom of the dock member. The floatation member has a body comprising a lower surface, an upper surface, side walls, a rear wall and a front wall which in combination define a chamber. At least one water port is formed in the lower surface of the body to place the chamber in communication with water when the floatation member is in use. An air port is formed in a surface of the body such that the air port is spaced above the at least one water port. An air tube is operatively connected at one end to the air port and is operatively connected at another end to a pump, the pump being operable to fill the chamber with air. A valve can be positioned in the air tube between the chamber and the pump. The valve is selectively positionable between a first position in which the pump is in communication with the chamber to urge air into the chamber, and a second position in which the chamber is placed in communication with the atmosphere. When the chamber is in communication with the atmosphere, weight on the dock member can cause the dock member to lower in the water. The lowering of the dock member will force water to enter the floatation member body through the water port, and air will exit the chamber through the air port.

In accordance with one aspect of the floatation system, the floatation member body can include a pair of spaced-apart ramp members extending rearwardly from the rear wall of the body. These ramp members help define an entrance to the dock member to which the floatation member is mounted.

In accordance with another aspect of the floatation system, the floatation member body includes at least one connector socket in at least one wall of the body. The connector socket comprises a socket main portion spaced inwardly from the wall of the body and a socket entrance portion extending from the wall to the socket main portion. The socket main portion and the socket entrance portion both open at the bottom of the body, and the socket main portion has a side-to-side width greater than the side-to-side width of the entrance portion. The socket entrance portion is defined by side walls; and the socket main portion is defined by a back wall, opposed side walls, and a front surface. The socket entrance portion opens into the front surface of the socket main portion. The connector socket of the floatation member is opened at the body upper surface, such that the connector socket of the floatation member can be aligned with the connector receiving socket of a dock member to which the floatation member will be connected.

In accordance with a further aspect of the floatation system, the floatation member includes a lower socket beneath the connector receiving socket. This lower socket is defined by side walls and a back wall; and is opened to the body wall over the full width of the lower socket.

In accordance with another aspect of the floatation system, the floatation member comprises channels formed in the lower surface of the chamber. The channels have one end in operative communication with at least one water port.

In accordance with a further aspect of the floatation system, the floatation member body includes positioning members on the upper surface of the body. These positioning members are sized to be received in recesses in the bottom surface of the dock member.

BRIEF DESCRIPTION OF THE SEVERAL VIEWS OF THE DRAWINGS

Corresponding reference numerals will be used throughout the several figures of the drawings.

DETAILED DESCRIPTION

Figure 1:
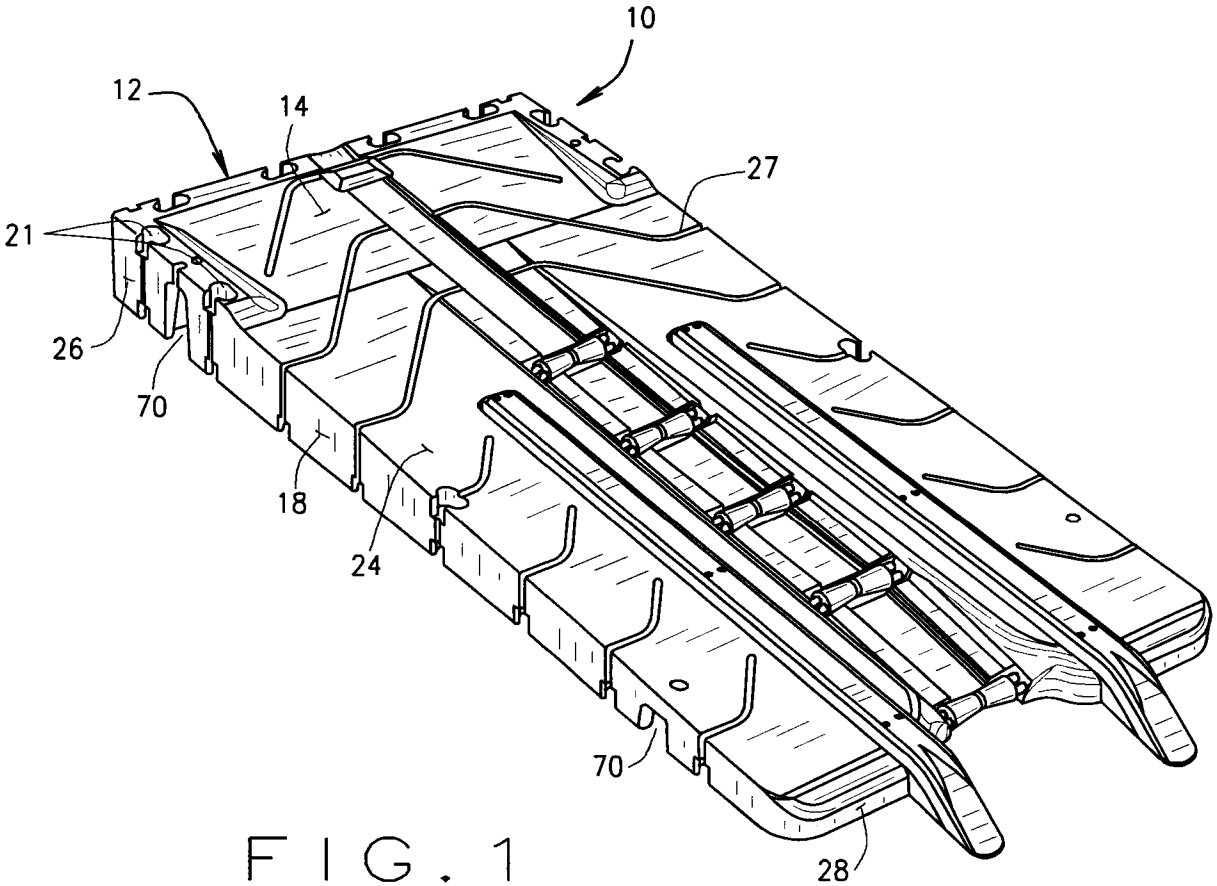
FIG. 1 is a perspective view of a dock member in the form of a watercraft lift.

The following detailed description illustrates the invention by way of example and not by way of claimed limitation. This description will clearly enable one skilled in the art to make and use the claimed invention, and describes several embodiments, adaptations, variations, alternatives and uses of the claimed invention, including what is presently believed to be the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

Figure 2:
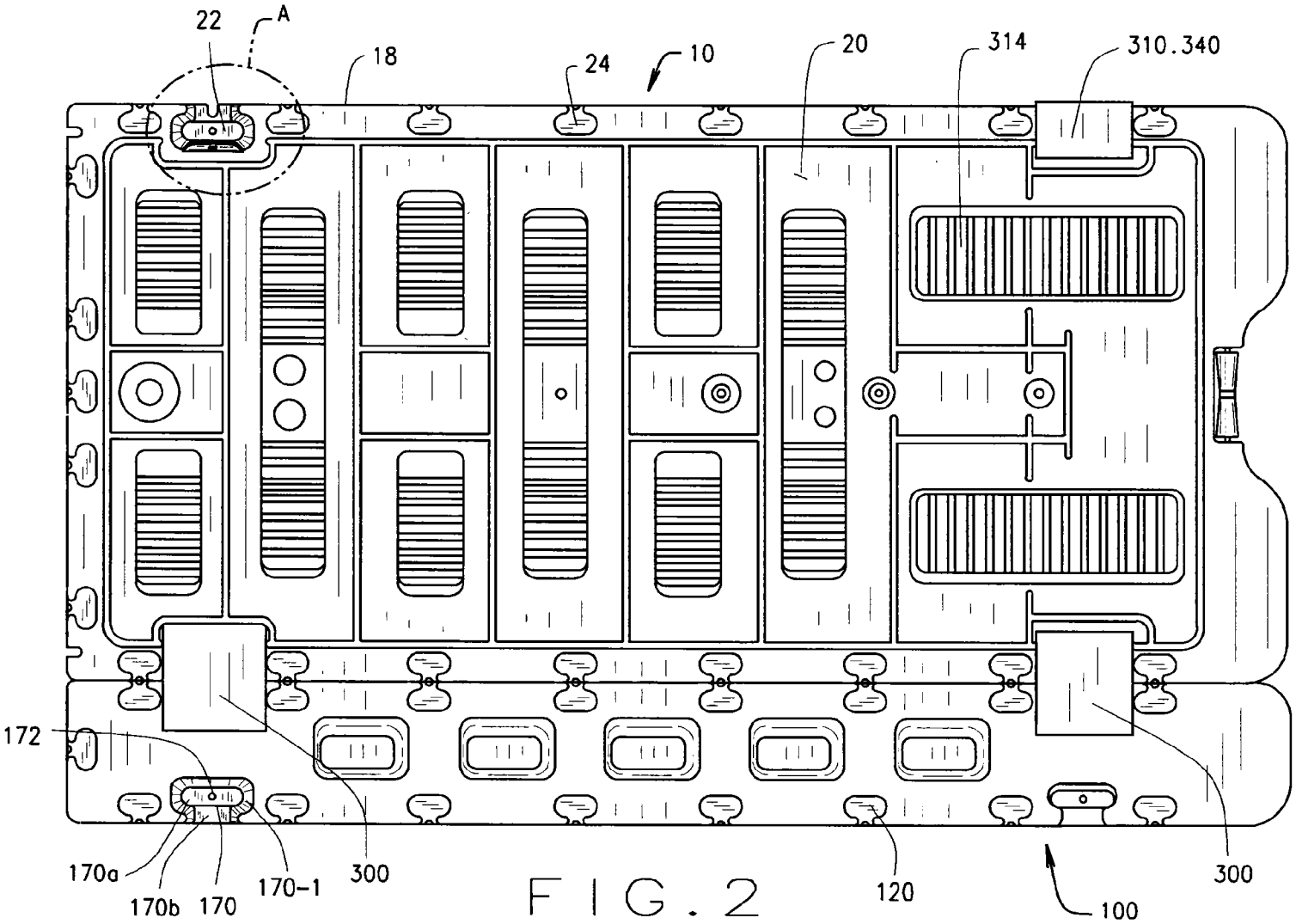
FIG. 2 is a bottom plan view of the watercraft lift with an associated expansion member.

FIGS. 1-2 show a dock member 10 in the form of a drive-on watercraft lift. Although a drive-on watercraft lift 10 is shown in the drawings, it will be apparent that the connectors described below can be used with other dock system components, such as dock sections. Such dock sections can be rectilinear, or any other desired shape.

The drive-on watercraft lift 10 includes an upper deck section 12 having a generally level top surface 14, a front wall 16, side walls 18, and a bottom surface 20. The front and side walls include connector receiving sockets 22 to enable the lift 10 to be incorporated in a dock system. The connector receiving sockets 22 receive connectors to secure dock members together to form a dock system. Additional connector slots 21 can also be provided. The connector slots 21 are designed for use with a connector comprised of an upper and lower portion joined by a rod, as described in U.S. Pat. No. 5,281,055 which is incorporated herein by reference. The drive-on watercraft lift 10 can be a lift such as described in co-pending (and co-owned) International App. No. PCT/US2011/060093 (published as WO2013/055378 and US2014/0248083) which claims priority to U.S. App. No. 61/545,395, both of which are incorporated herein by reference.

Figure 3A:
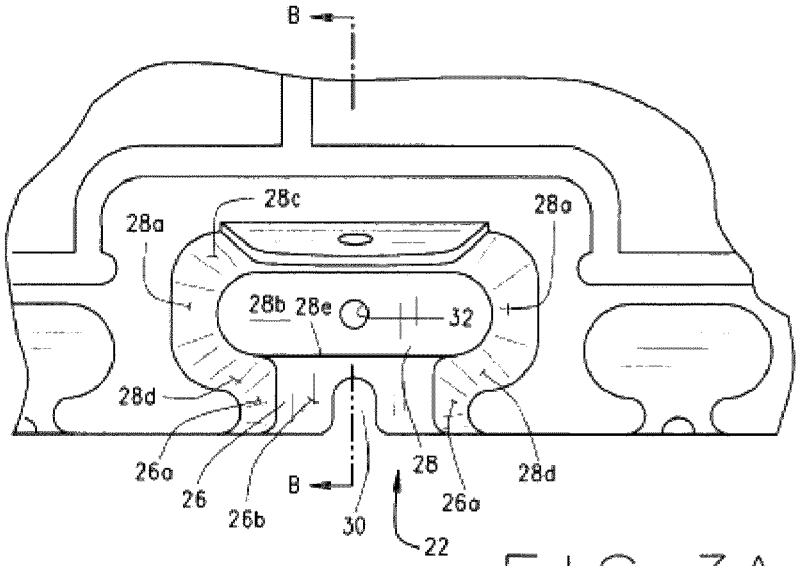
FIG. 3A is an enlarged bottom plan view taken along circle A of FIG. 2 showing a connector receptacle of the dock member.
Figure 3B:
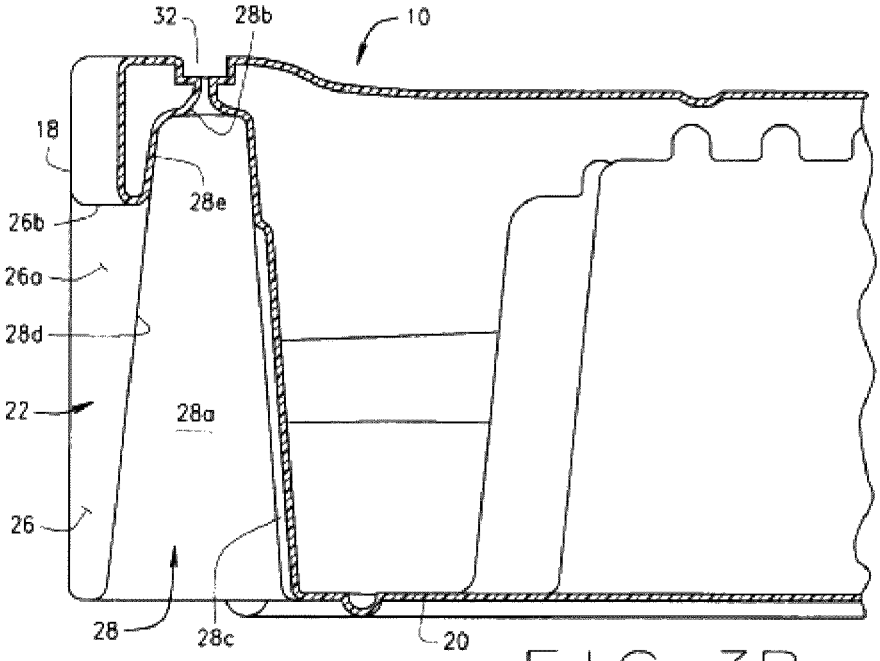
FIG. 3B is a cross-sectional view of the connector receptacle taken along line B-B of FIG. 3A.

The connector sockets 22 are shown in more detail in FIGS. 3A and 3B. As seen therein, the connector socket 22 is opened at the bottom surface 20 of the dock member. The connector socket 22 is generally T-shaped, with an entrance section 26 and a main section 28. The entrance section 26 is narrower (side-to-side) than the main section 28, and is defined by opposed sloping side walls 26*a* and an upper surface 26*b*. The main section 28 is defined by sloped side walls 28*a*, an upper surface 28*b*, a sloped back wall 28*c*, and forward surfaces 28*d* on opposite sides of the entrance section 26. As seen in FIG. 3B, the main section upper surface 28*b* is vertically above the entrance section upper surface 26*b*, and hence, the upper portion of the main section 28 further includes a forward surface 28*e*, which faces the back wall 28*c*. As noted, the entrance section 26 is narrower (side-to-side) than the main section 28, and hence, the entrance section 26 defines an entrance to the main section 28. Additionally, the entrance section upper surface 26*b* includes a generally U-shaped cut out 30 and a hole 32 extends from the upper surface 14 of the dock member through to the upper surface 28*b* of the socket main section 28. As seen in FIG. 3B, the opening 32 is countersunk.

Figure 4A:
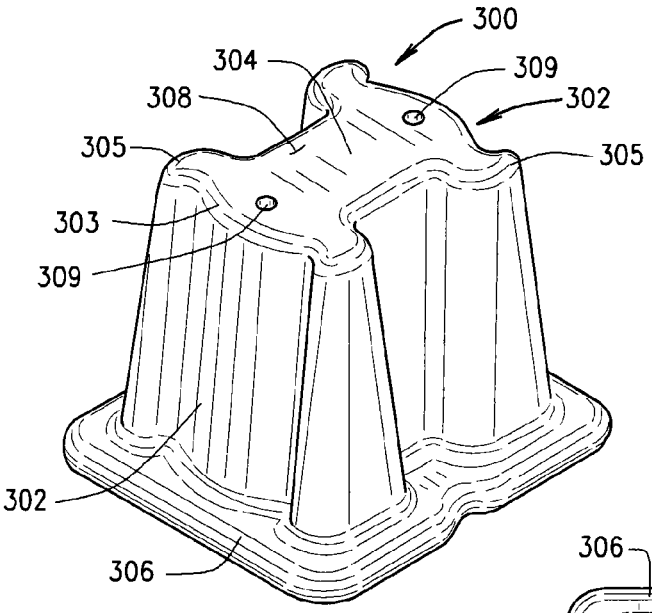
FIGS. 4A and 4B are perspective and top plan views of a first full connector.
Figure 4B:
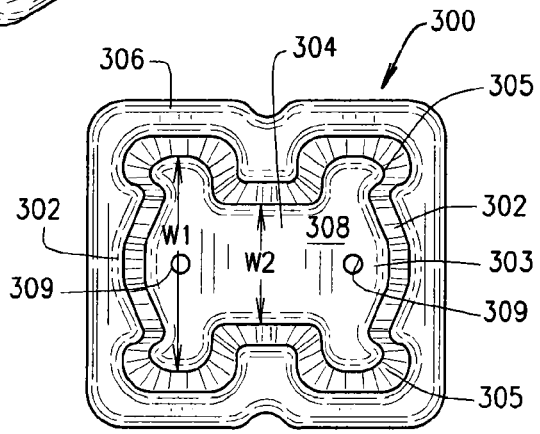

Two dock members 10 are connected by means of full connectors 300. A first full connector 300 is shown in FIGS. 4A-B. The first full connector 300 includes a pair of generally tapered handlebar-shaped posts 302 connected by a brace 304. The brace is illustratively shown to be in the shape of a generally rectangular prism. The posts 302 have a side-to-side width W1 which is approximately equal to the side-to-side width of the socket main section 68; and the brace has a side-to-side width W2 which is approximately equal to the side-to-side width of the socket entrance section 26. Hence, the side-to-side width W1 of the connector post is greater than the side-to-side width W2 of the brace 304. Each post 302 includes a generally convex midsection 303 connecting a pair of generally curved or falcate end portions 305. The overall shape of the post end portions 305 give the end portions a shape generally similar to a dorsal fin. The posts 302 and the brace 305 are of substantially the same height, such that the connector 300 defines an upper surface 308 that is generally flat. A flange 306 extends around the entire base of the connector 300. As seen, the side surfaces of the connector 300 slope outwardly, such that the combined perimeter of the connector posts and brace is larger at the base of the connector than at the top of the connector. Finally, openings 309 are formed in the posts 305, and are positioned to be aligned with the openings 32 in the connector socket main section 28 when received in the connector socket.

Figure 5A:
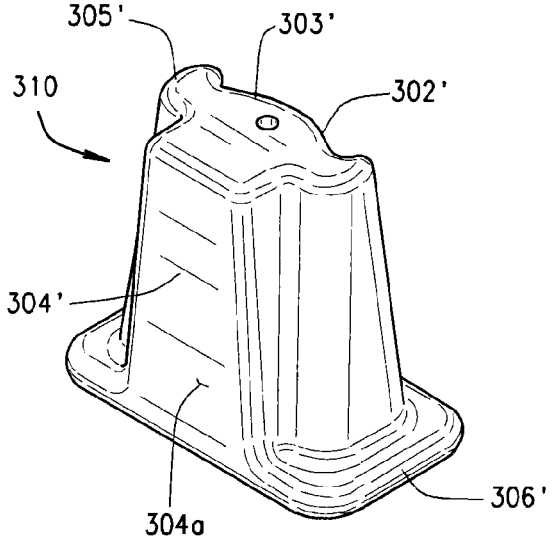
FIGS. 5A and 5B are perspective and top plan views of a first half connector.
Figure 5B:
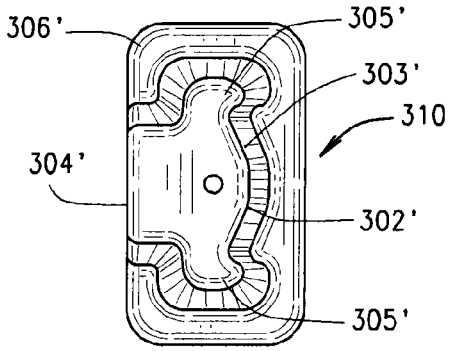

Often times it is desirable to connect an accessory to the dock member (as opposed to connecting two dock members together). A first half connector 310 can be used for this purpose. A half connector 310 is shown in FIGS. 5A-B. The half connector 310 includes only a single post 302' and a brace 304' which is one half the length of the brace 304 of the full connector 300, so that the second connector 310 is effectively the shape and size of one half of the full connector 300 (i.e., the full connector 300 cut vertically through the center of the brace 304). The post 302' is shaped identically to the post 302 of the full connector 300. The half connector brace 304' has an outer wall 304*a* which faces away from the post 302. The half connector 310 can be used, as seen in FIG. 2, where the outer surface 304*a*, will form a portion of the edge of the dock system. As with the connector 300, the connector 310 defines an upper surface that is generally flat. A flange 306' extends around the entire base of the connector 310. As seen, the side surfaces of the connector 310 slope outwardly, such that the combined circumference of the connector post and brace is larger at the base than at the top of the connector.

Figure 6A:
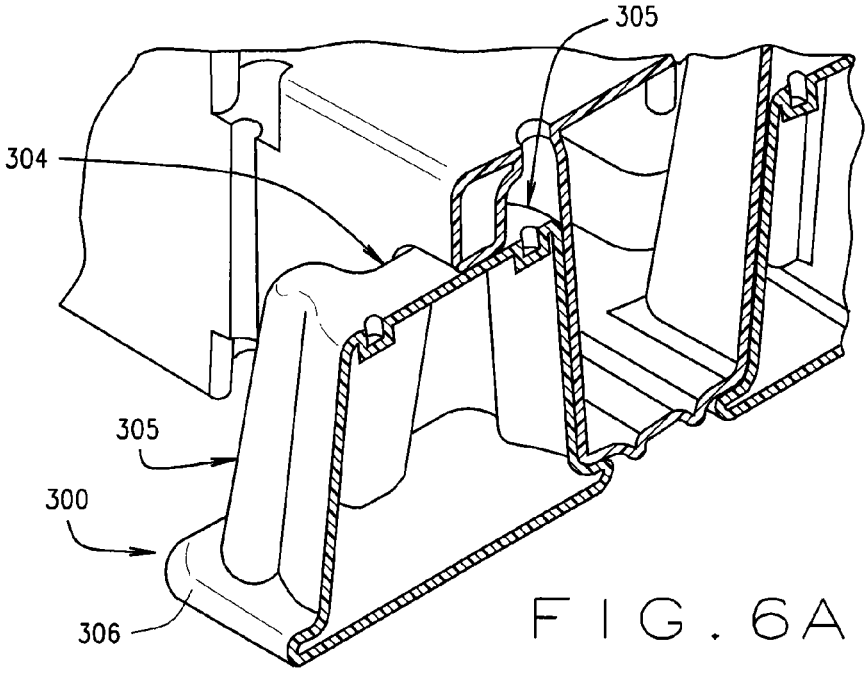
FIG. 6A is a cross-sectional perspective view showing a full connector received in a connector socket of the dock member.
Figure 6B:
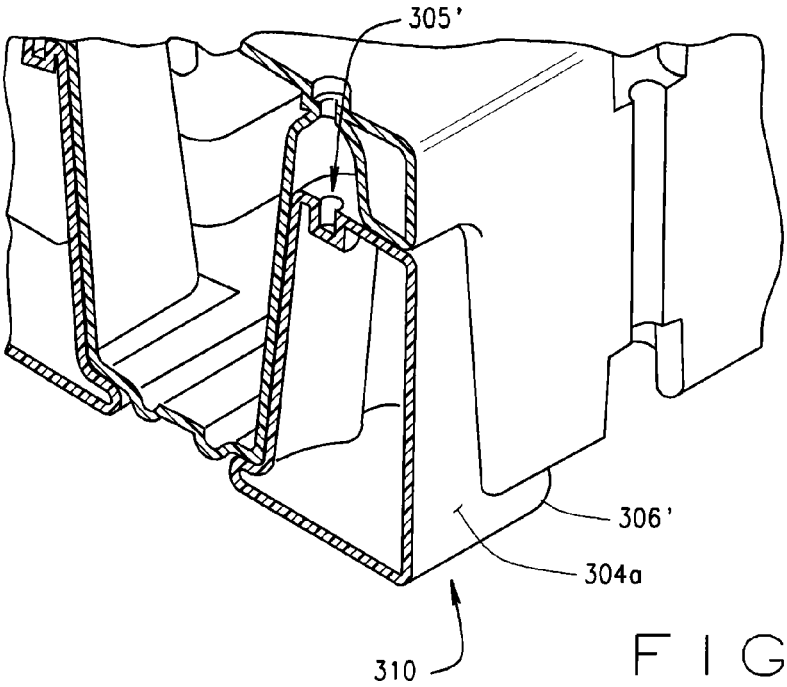
FIG. 6B is a cross-sectional perspective view showing a half connector received in a connector socket of the dock member.
Figure 6C:
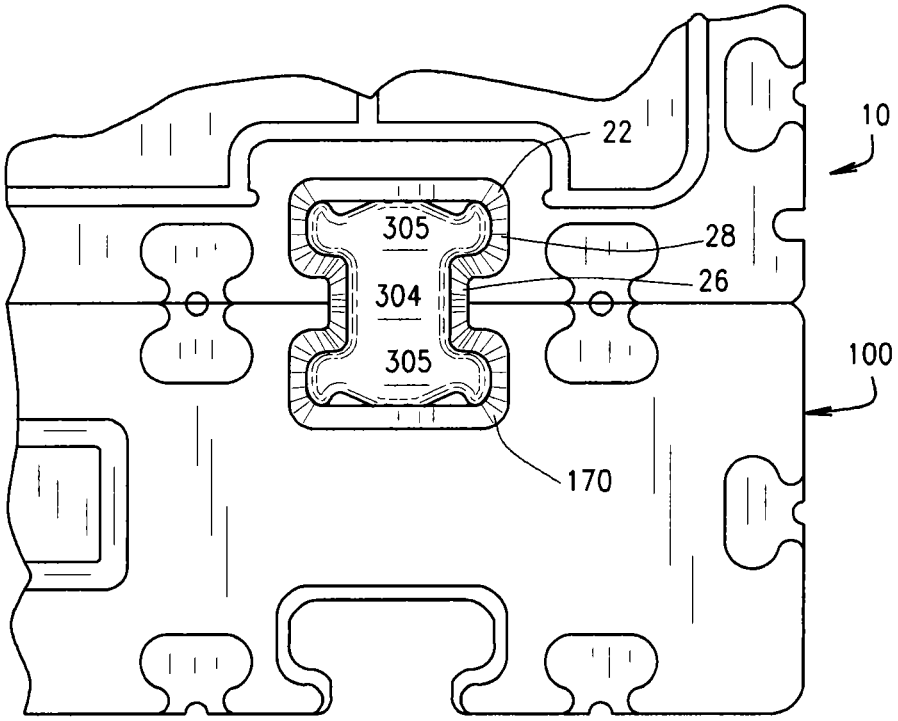
FIG. 6C is an enlarged plan view showing two dock members connected by a full connector.

FIGS. 6A-C show the connectors 300 and 310 received in connector sockets 22. For each connector, a post 305, 305' is received in the socket main section 28, and the post 304, 304' extends through the entrance section 28. As best seen in FIG. 6C, the forward edge of the connector post 305 engages the forward edge 28*d* of the socket main section 28. Hence, when to dock members are connected via the connector 300, as shown in FIG. 6C, the connector posts 305 will form an interference fit with the socket main section walls 28*e* to prevent horizontal separation of the two dock members.

Figure 7:
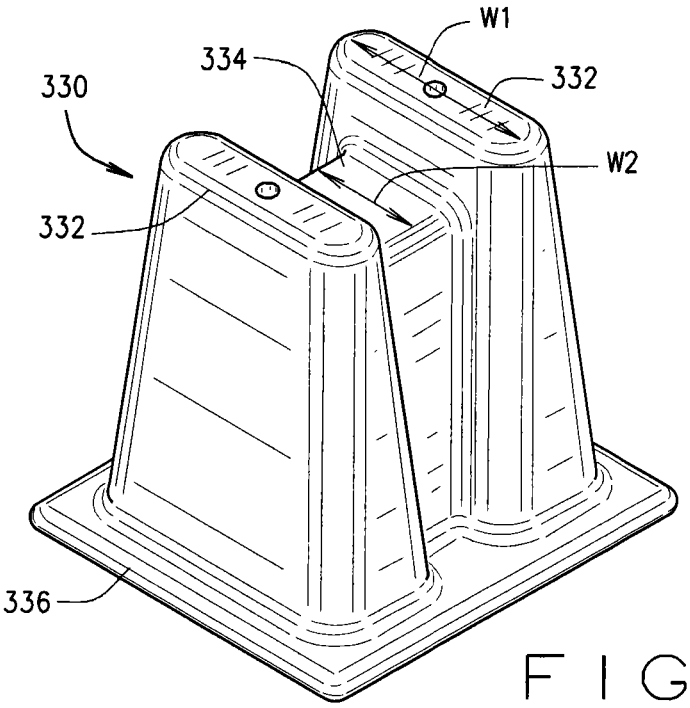
FIG. 7 is a perspective view of a second full connector.
Figure 8:
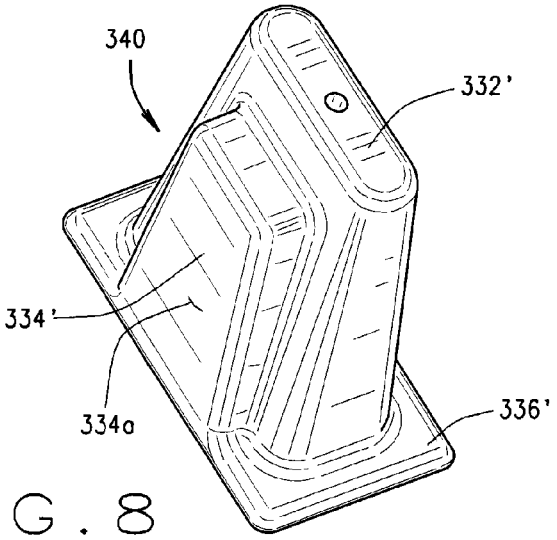
FIG. 8 is a perspective view of a second half connector.

An alternate construction of the full and half connectors 330 and 340, respectively, are shown in FIGS. 7 and 8. As will be appreciated from the following description, the second full and half connectors 330 and 340 will operate in the same manner as the connectors 300 and 310.

The second full connector 330 includes a pair posts 332 connected by a brace 334. The posts 332 are shown to be in the shape of a generally truncated rectangular pyramid. The brace 332 is shown to be in the shape of a generally rectangular prism. The posts 332 are taller than the brace 334, such that the upper surfaces of the posts 332 are spaced vertically from the upper surface of the brace 334. The posts 332 have a side-to-side width W1 greater than the side-to-side width W2 of the brace 334. A flange 336 extends around the entire base of the full connector 330.

The second half connector 340, shown in FIG. 8, is based on the second full connector 330. This half connector 340 includes only a single post 332' and only half of the brace 334', so that the half connector 340 is effectively the shape and size of half of the connector 330 (i.e., the full connector 330 cut vertically through the center of the brace 334'). As with the half connector 310, the brace 334 of the half connector 340 has an outer generally vertical wall 334*a* which faces away from the connector post 332'. As with the full connector 330, the upper surface of the post 332' is spaced above the upper surface of the brace 334'. Additionally, the side surfaces of the connector 340 slope outwardly, such that the combined perimeter of the connector post and brace of the connector is larger at the base than at the top of the connector.

Figure 9:
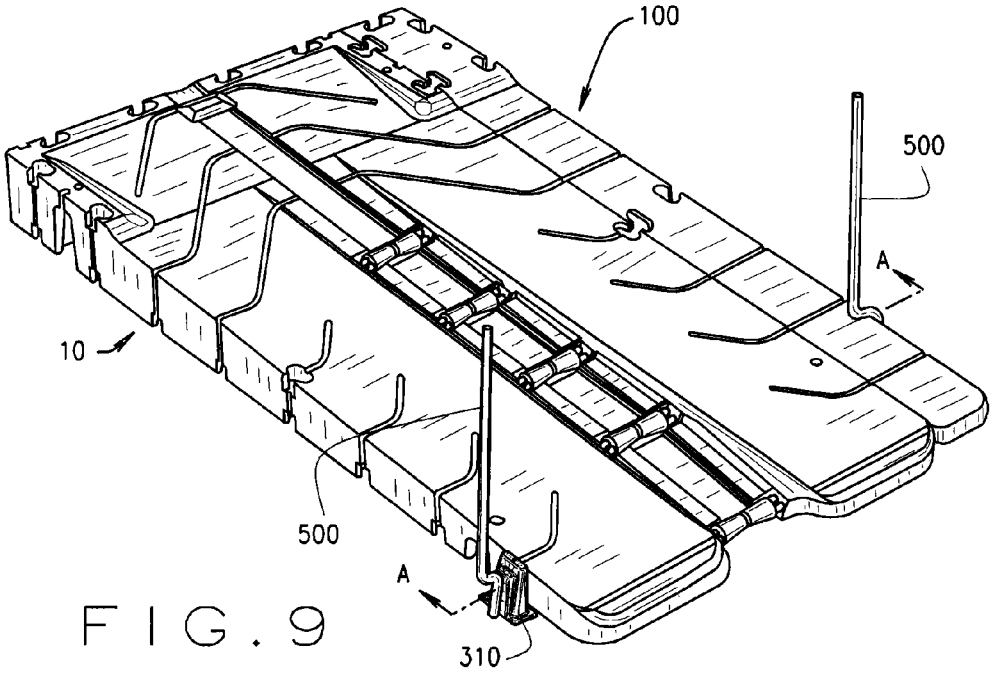
FIG. 9 is a top perspective view of the watercraft fitted with an expansion member and accessories in the form of guide posts.

As noted above, the dock member 10 can be a drive-on watercraft lift, such as disclosed in U.S. Pat. App. No. 61/545,395 and International App. No. PCT/US2011/060093 (published as WO2013/055378 and US2014/0248083), both of which are incorporated herein by reference. The watercraft lift 10 has a side-to-side width that is narrow, and hence, the sides of a watercraft received on the watercraft lift may extend out to the edge of the watercraft lift 10, or even overhang the watercraft lift 10. For design considerations, it may not be desirable (or it may not be feasible) to provide a full width dock member alongside the watercraft lift 10. Hence, an expansion member 100 can be connected to the watercraft lift, as shown if FIG. 9. The profile of the expansion member 100 generally corresponds to the profile of the lift 10, but the expansion member 100 is not as wide. The expansion member 100 includes a sloped section 122 extending rearwardly from an upper deck section 110. The upper deck section 110 includes an upper surface 124, a side wall 118, and a forward wall 126. The rearwardly sloping section 122 includes an upper surface 128, side surfaces 130 and a rear edge 132. The rearwardly sloping section 122 slopes downwardly and rearwardly, such that its side walls 130 are shorter at the rear edge 132 then at the front of the receiving section 122 (the back of the deck section 110). As can be seen, the side walls 130 are a continuation of the side walls 118 of the upper deck section 110. Narrow grooves 127 are formed in the upper surfaces 128 of the rearwardly sloping section 122. As seen in FIG. 9, the grooves 127 in the expansion member 100 are positioned to align with corresponding grooves in the watercraft lift 10 when connected thereto. The grooves 127, as is known, facilitate removal of water from the upper surfaces 124 of the expansion member 100.

The side walls of the expansion member 100 include connector receiving sockets 170 to enable the expansion member 100 to be incorporated in a dock system. Additional connector slots 120 and 121 are provided to connect or mount attachments to the expansion member 100. The connector receiving sockets 170 are identical to the connector receiving sockets 22 of the dock member 10. The connector receiving sockets of the dock member 10 and the expansion member 100 are positioned such that they will be aligned with each other, as seen in FIG. 6C, when the two members are adjacent each other. With reference to FIG. 2, the sockets 170 include a first portion 170*a* which is spaced inwardly from the wall of the watercraft lift and is shaped and sized to receive the connector post 302. For example, the socket portions 170*a* can have a generally truncated rectangular pyramid shape for seating of the connector post 302 in the sockets 170. The socket portions 170*a* extend upwardly from the bottom surface of the watercraft lift to a top surface 170-1. A socket connection portion 170*b* extends from the side wall of the watercraft lift to the socket portion 170*a*. The socket portion 170*b* extends upwardly from the bottom surface of the watercraft lift 10, but is shorter than the socket portion 170*a*. Further, the socket portion 170*b* is narrower (side-to-side) than the socket portion 170*a*. Hence, the socket portion 170*b* can be seen as an entrance to the socket portion 170*a*.

As seen in FIGS. 2 and 6C, when expansion unit 100 is placed adjacent the lift 10, the connector sockets 170 of the expansion 100 unit align with the connector sockets 22 in the lift 10. The sockets 22 and 170 are generally identical. Hence, when a full connector 300 is used to connect the two members, the opposed posts 302 will be received in the socket portions 28 and 170*a* of the connector receiving sockets 22 and 170, respectively; and the brace 304 will extend through the socket entrance portions 26 and 170*b* of the connector receiving sockets 22 and 170, respectively. Because the connector posts 302 and the socket main portions 28 and 170*a* are wider than the brace 302 and the socket entrance portions 26 and 170*b*, the connector posts 302 will engage the wall of the socket main portions 28 and 170*a* proximate the side wall of the lift and expansion member to prevent the lift 10 and the expansion member 100 from separating. That is, the full connector 300 will form an interference fit with the connector receiving sockets of the two dock members to hold the two dock members together. Additionally, as seen in the figures, the posts 302 of the full connector include holes 309 in their top surfaces. These holes align with the holes 32 and 172 in the upper surfaces of the sockets 22 and 170, respectively, when the connectors are received in the sockets. Screws, bolts or the like can be driven through these holes in the dock members and into the connector posts 302 to further secure the connectors in place.

As noted above, the full connectors 300 form a flat upper surface, and in the connectors 330, the top of the posts 332 are above the top surface of the brace 334. When the connector 330 is placed in the socket 170, the post 332 of the connector 330 will extend up to the top surface of the connector socket 170. However, the connector 300 is shorter than the connector 330, and has a height equal to the height of the socket entrance portion, as seen in FIG. 6B.

Figure 11:
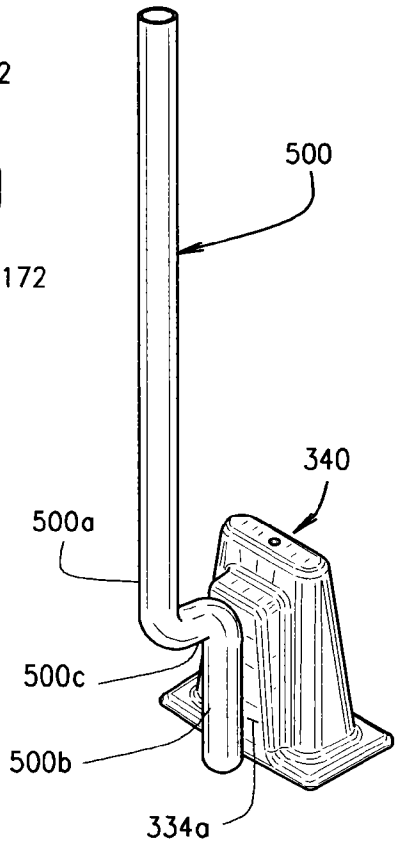
FIG. 11 is a perspective view of a guide post mounted on a half connector.
Figure 10:
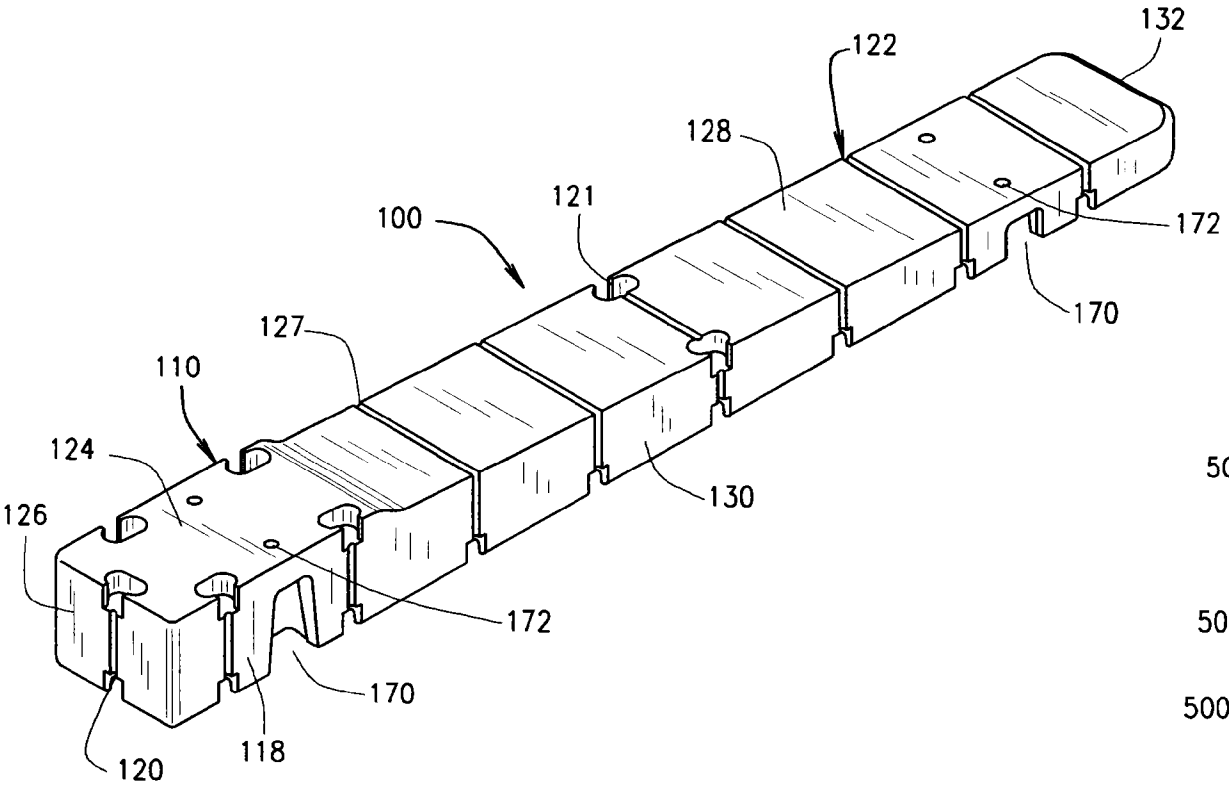
FIG. 10 is a perspective view of the expansion member.
Figure 12:
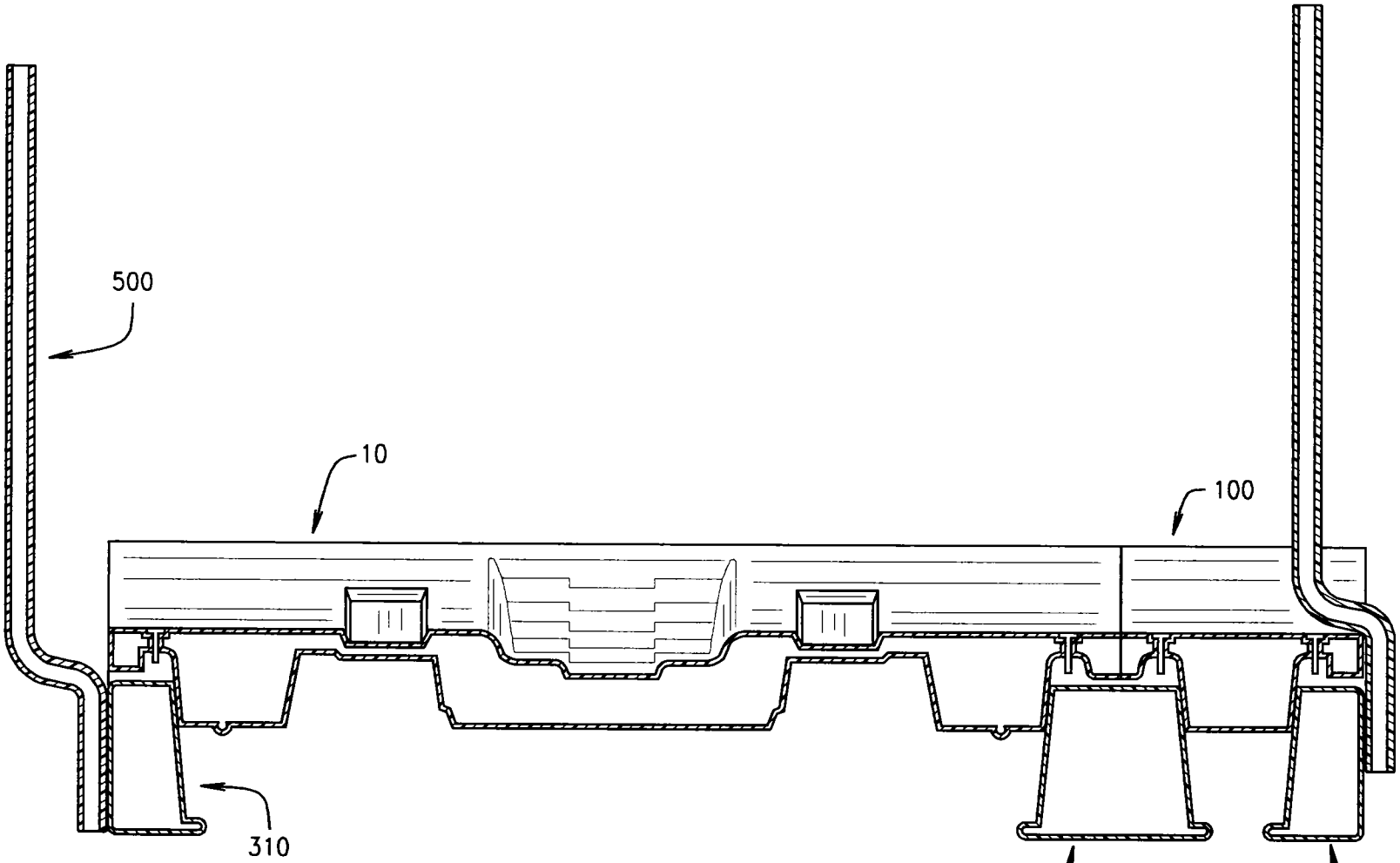
FIG. 12 is a cross-sectional view taken through line A-A of FIG. 9 showing the connection of the expansion member to the lift and the connection of guide posts to the lift and expansion member.

Oftentimes it is desirable to mount an accessory to a dock system member. Such accessories can include any number of items, such as posts, benches, ladders, etc. These accessories are mounted to the dock member by means of a half connector. FIGS. 3 and 3A show accessories, in the form of a guide post 500, mounted to the dock system. As shown in FIG. 11, a guide post 500 can be mounted to the outer wall of a half connector. Although the guide post 500 is shown mounted to the connector 340, it will be apparent that the guide post (as well as any other accessory) could be secured to the outer wall 304*a* of the half connector 310. The half connector is received in a socket 170 of the expansion member 100 or in a socket 22 of the lift 10 in the same manner as the full connectors. The guide post 500 (as seen in FIG. 11) is generally r-shaped or generally s-shaped, having a upper generally vertical section 500*a* and a lower generally vertical section 500*b* joined by a transverse section 500*c*. The upper section 500*a* extends generally vertically upwardly from the half connector. The guide post can be mounted to the outer wall of the half connector brace by means of a tube, for example, which would allow the guide post to be rotated and/or raised relative to the half connector. This will allow for the post to extend away from the lift, as shown on the left side of FIGS. 9 and 12 or extend over the lift as shown on the right side of FIGS. 9 and 12. The guide posts 500 are provided to facilitate steering of a watercraft onto the lift 10 by marking the entrance to the lift 10. Preferably, the entrance to the lift 10 will be about mid-way between the two posts. The ability of the guide posts to be pivoted relative to the half-connectors allows for the guide posts to be used with different sized watercraft. For example, when a smaller watercraft (such as PWCs) is to be driven onto the lift, the guide posts can both face inwardly (such as the guide post on the right side of FIGS. 9 and 12). Conversely, when a larger watercraft is to be driven onto the lift, the guide posts can both be positioned to face outwardly (such as the guide post on the left side of FIGS. 9 and 12). The guide posts 500 are preferably made from a metal, but any suitable material can be used, including, but not limited to, plastic and wood.

Figure 17:
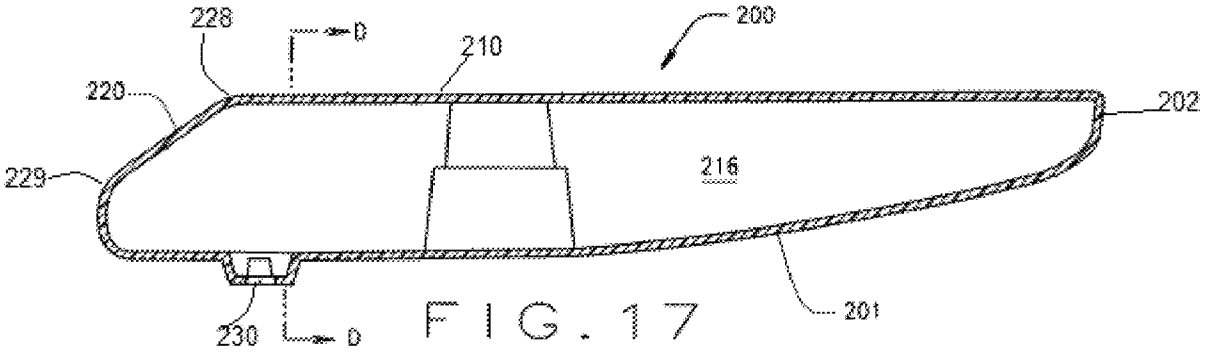
FIG. 17 is a cross sectional view taken along the line C-C of FIG. 15A, showing an outlet of the supplemental floatation member.
Figure 18:
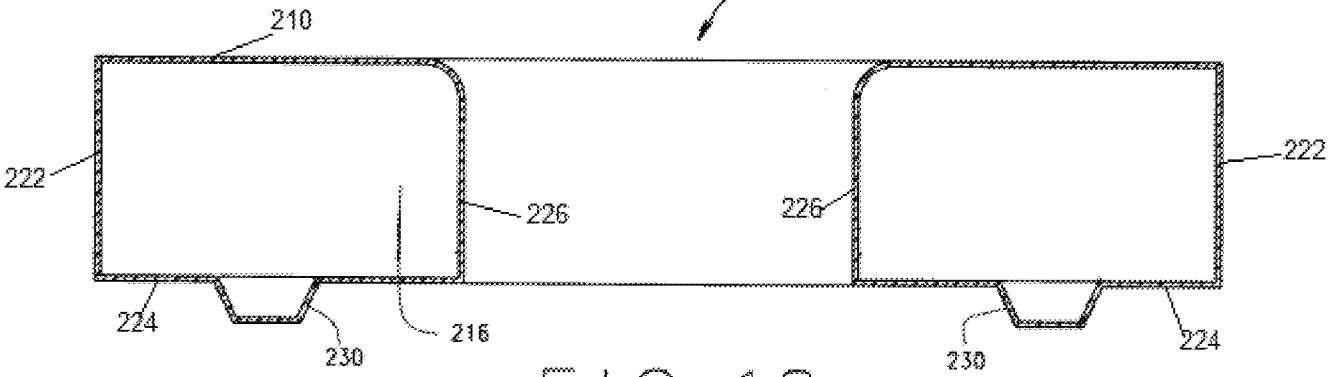
FIG. 18 is a cross-sectional view of the floatation member taken along lines D-D of FIGS. 16 and 17.

Watercraft are generally back heavy. Thus, when a watercraft is docked on the watercraft lift 10, the lift will slope rearwardly. That is, the back of the lift 10 will be lower than the front of the lift 10. In fact, if the rear of the watercraft is heavy enough, the back edge of the lift 10 may be submerged, and the watercraft engine may remain in the water. To raise the back of the lift 10, so that the lift 10 can raise the back of the watercraft out of the water, a supplemental floatation member 200 can be mounted to the bottom rear of the lift 10, as seen in FIGS. 2, 17 and 17B. Although primarily meant for use with a lift, the supplemental floatation member 200 could also be mounted to a different dock member (such as a dock section that is used to form a pier or walkway of a dock system) should such a dock member need additional buoyancy.

As shown in FIGS. 14-19, the supplemental floatation member 200 has a lower surface 201, a generally vertical front wall 202, generally vertical side walls 204, and a pair of ramp members 206 separated by, and extending rearwardly from, a rear wall 208. The ramp members 206 give rear of the floatation member 200 a U-shaped appearance. The forward portion of the bottom surface 201 gently slopes or curves upwardly. The floatation member 200 is hollow and defines a chamber 216. A generally horizontal upper surface 210 defines a raised portion 212 shaped and sized to seat with corresponding recesses 314 (FIG. 2) in the lower surface of the watercraft lift 10. The raised portion 212 is generally U-shaped being formed from three individual rectangular prism shapes. However, those skilled in the art will recognize that the raised portion 212 can comprise any shape and size that can seat within the recesses 314 the lower surface of the lift 10. The raised portion 212 can define a positioner for positioning the floatation member 200 relative to the lift 10.

Each ramp section 206 is shaped generally as a triangular prism that includes a sloped ramp surface 220, a generally vertical outer side wall 222, a bottom 224, and an inwardly angled inner side wall 226. The upper edge 228 of the sloped ramp surface 220 is generally parallel with upper surface 210, while a lower or back edge 229 is generally below the upper edge 228. The sloped ramp surface 220 extends rearwardly and downwardly from the upper surface 210. The upper edge 228 (which defines a junction between the ramp section 206 and the upper surface 210) is generally wider than the width of the lower edge 229. When the floatation member 200 is positioned relative to the lift 10, the ramped sections extend rearwardly from the back of the lift on opposite sides of the entrance to the lift, as seen, for example, in FIG. 13. Hence, the ramped sections 206 further define the entrance to the lift. Further, the configuration of the sloped ramp surface 220 and inwardly angled inner side wall 226 can guide a watercraft entering the receiving section 22 and aid alignment.

Figure 15A:
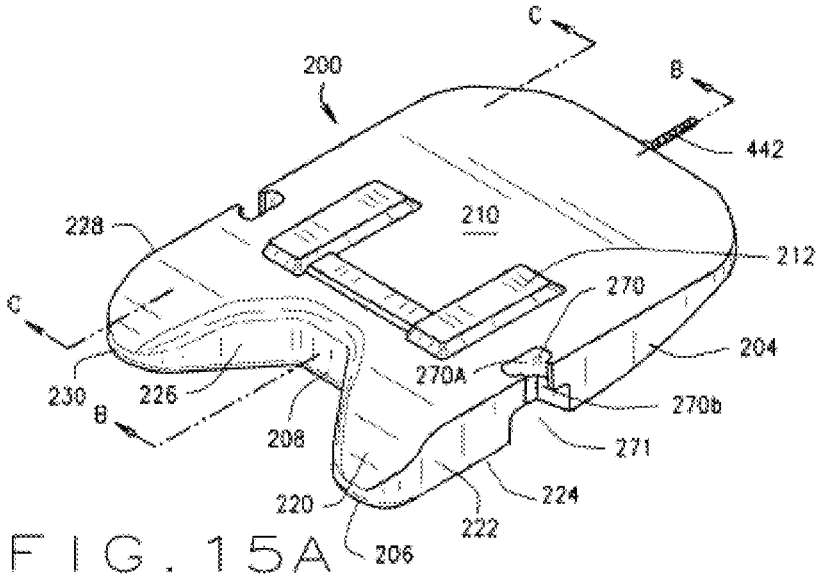
FIGS. 15A and 15B are top and bottom perspective views of a second illustrative embodiment of the supplemental floatation member.
Figure 15B:
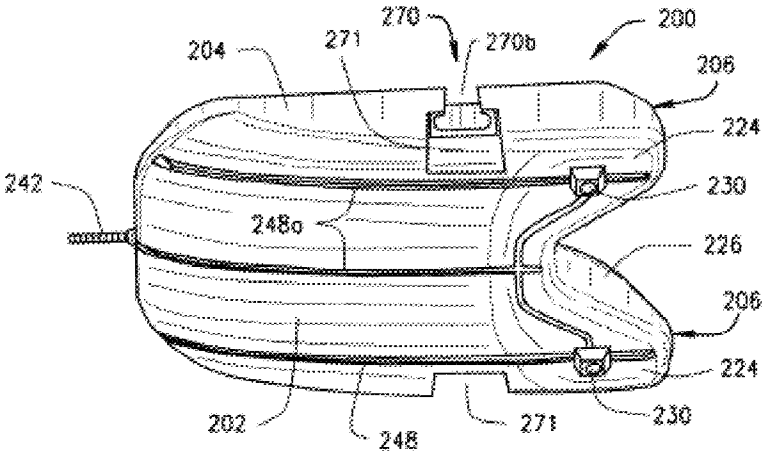

The side walls 204 of the floatation member 200 include connector receiving sockets 270 to enable the floatation member 200 to be connected to the lift 10. The sockets 270 are shaped similarly to the sockets 170 of the expansion member 100. However, unlike the socket 170, the socket 270 is opened at both the top and bottom of the socket. The socket 270 includes an entrance portion 270*b* which extends from the side wall of the floatation member to a wider first portion 270*a*. As seen in FIG. 15A, the socket is opened to the wall 204 of the floatation member along the full height of the socket. The floatation member further includes a lower slot 271 below the socket 270 which has sloped slide walls and a rear wall. This lower slot 271 is fully open at the wall 204 and is sized to permit the bottom flange of the connector to be received in the slot. As seen in FIG. 15B, the socket 270 extends upwardly from the top of the lower slot 271 and has a lower opening that is smaller in area that the upper surface of the slot 271.

Figure 13:
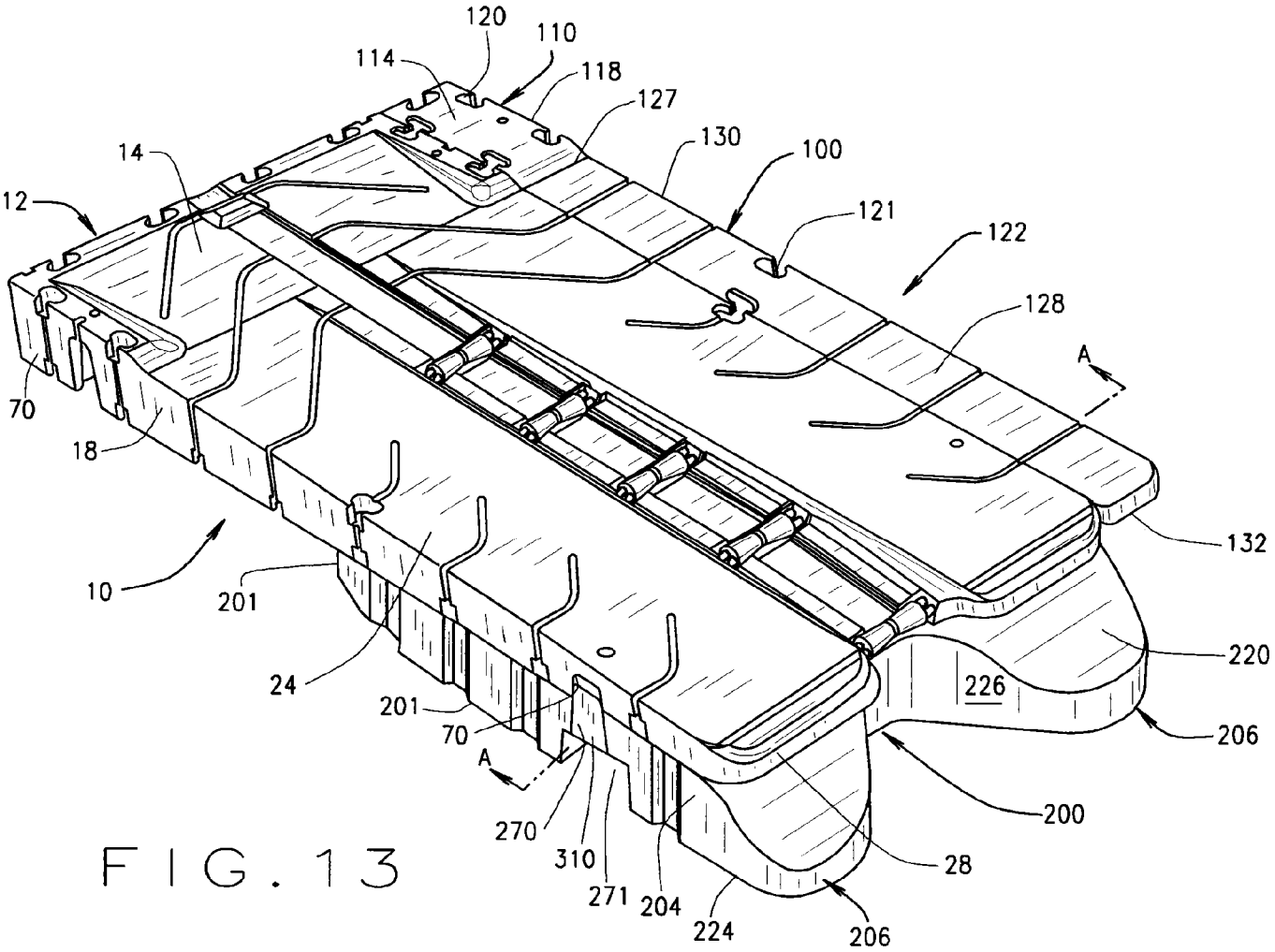
FIG. 13 is a perspective view of a watercraft lift fitted with an expansion member and a supplemental floatation member.
Figure 14:
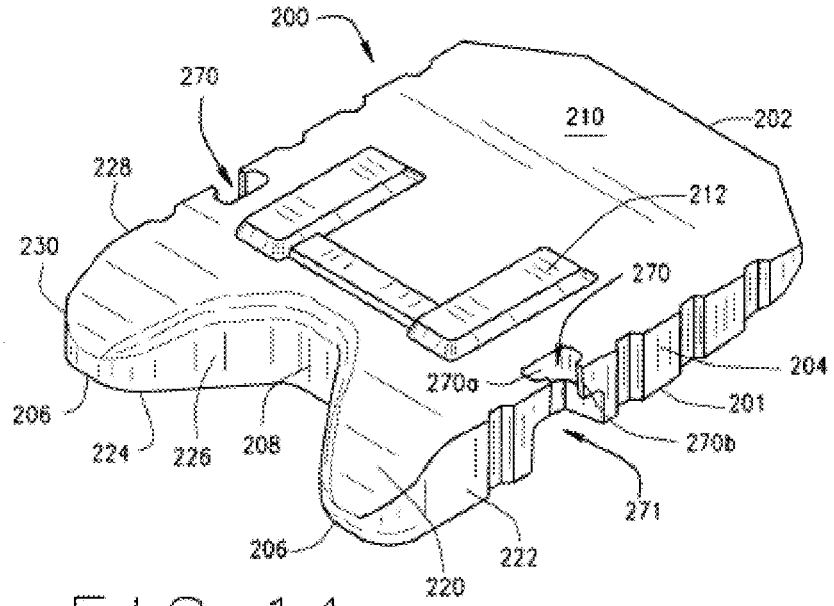
FIG. 14 is a perspective view of a first illustrative embodiment of a supplemental floatation member.
Figure 20:
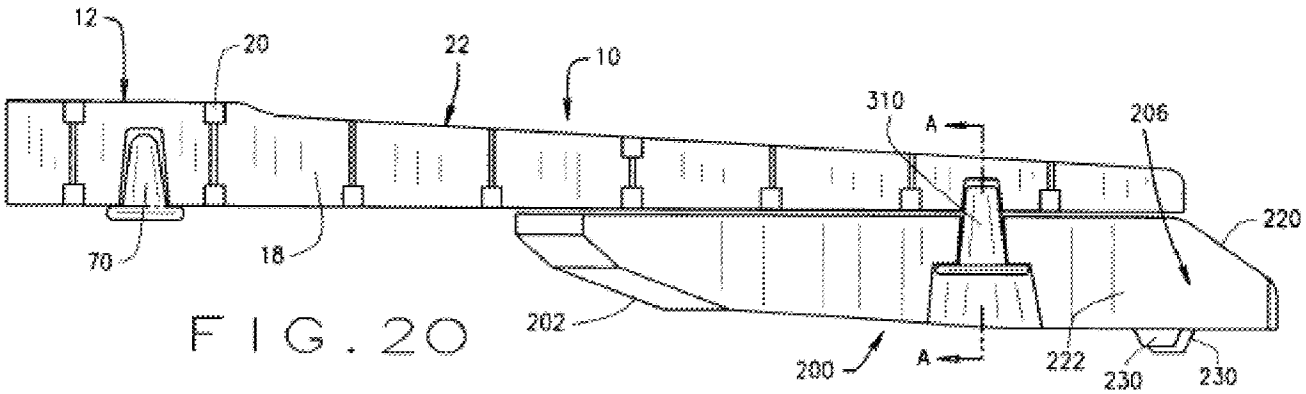
FIG. 20 is a side elevational view of the watercraft lift and supplemental floatation member secured together.
Figure 20A:
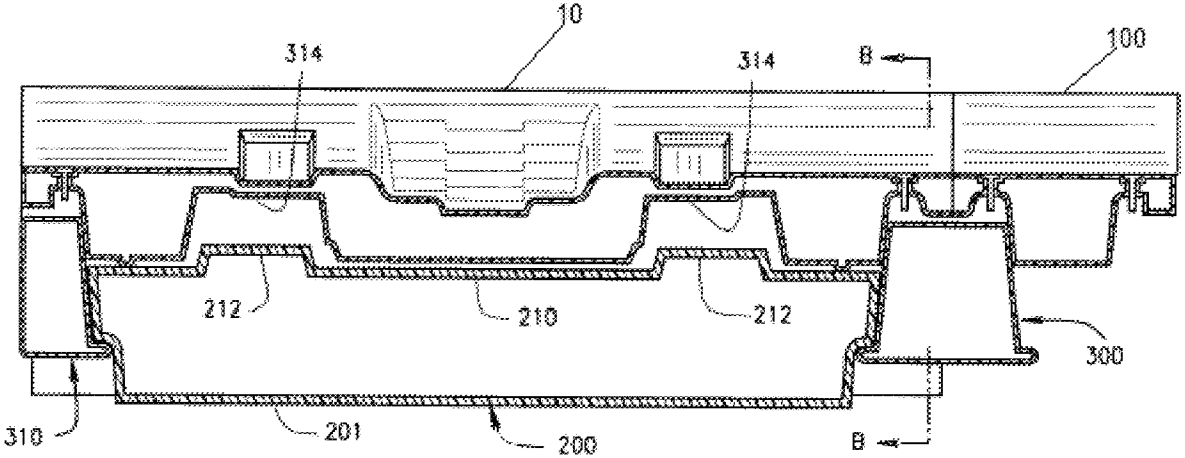
FIG. 20A is a cross-sectional view of the floatation member mounted to the lift and expansion member taken along line A-A of FIG. 20.
Figure 20B:
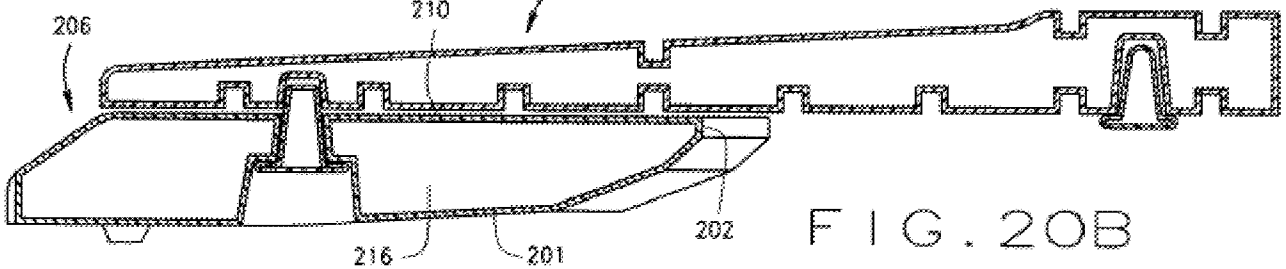
FIG. 20B is a cross-sectional view of the floatation member mounted to the lift and expansion member taken along line B-B of FIG. 20A.

As seen in FIG. 20A, either full or half connectors can be used secure the floatation member 200 to the lift 10. When the floatation member is positioned relative to the lift, the floatation member socket 270 will be positioned below the lift socket 22. The connector post is received in the socket first portion; and the connector brace extends into the socket entrance portion. The connector extends through the top of the socket 270 into the socket 22 of the lift, as seen in FIGS. 13 and 20A-B. Thus, as can be appreciated, the socket 270 of the floatation member 200 is shorter than the connector. The brace of the half connectors is one-half the length of the brace of the full connectors, and the half connector braces have a side surface which is flush with the side wall of the lift 10, when the floatation member is connected to the lift, as seen in FIGS. 13 and 20A. Additionally, as seen, the braces of the half connectors close the opening into the connector sockets. In FIG. 20A, a half connector is shown on the left side of the figure. However, on the right side of the figure, where an expansion member 100 is also connected to the lift 10, a full connector is used.

Figure 16:
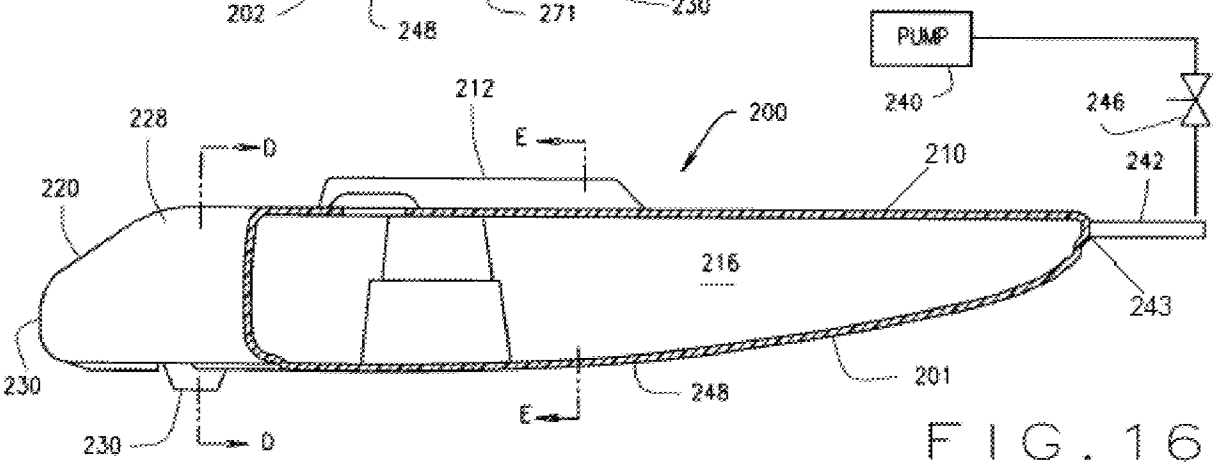
FIG. 16 is a cross-sectional view taken along the line B-B of FIG. 15A, showing the interior of the supplemental floatation member.
Figure 19:
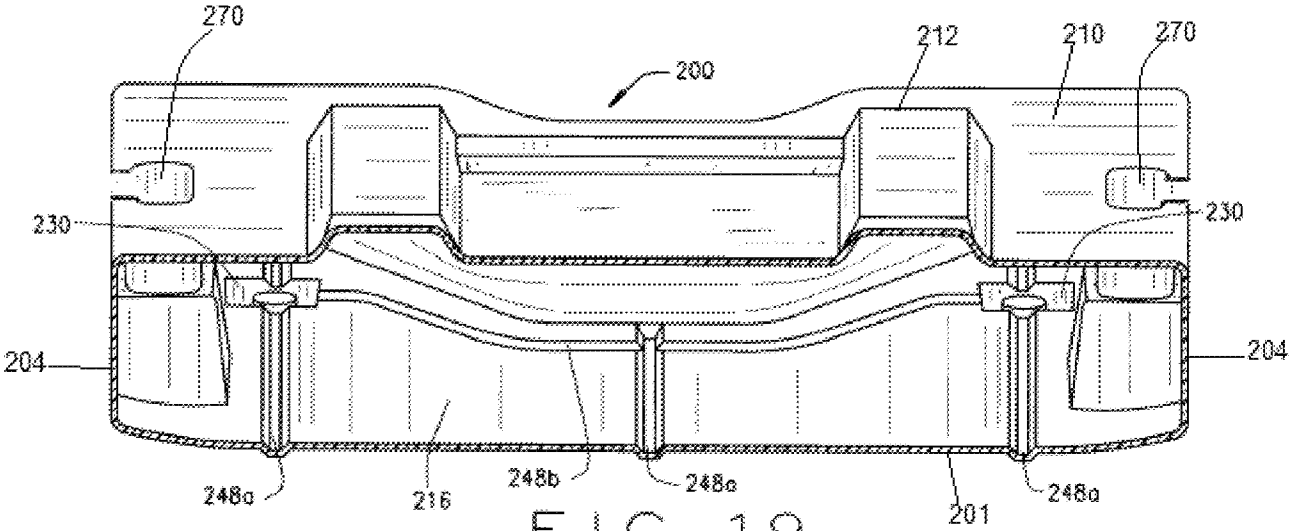
FIG. 19 is a cross-sectional view of the floatation member taken along line E-E of FIG. 16.

The floatation member 200 has ports 230 in its lower surface which place the chamber 216 of the floatation member 200 in communication with the exterior of the floatation member. As seen, the ports 230 are positioned towards the rear of the floatation member near the ramped sections 206. The floatation member 200 is operatively connected to a pump 240 (FIG. 16) by way of an air tube 242 which is connected to an air port 243 in the floatation member at the front of the floatation member to place the pump control unit in communication with the interior of the floatation member. The entrance of the air tube to the chamber 216 (i.e., the air port 243) is above the level of the ports 230, and preferably near the top surface of the floatation member, as seen in FIG. 16. A valve 244 is placed in the line with the air tube 242. The valve is selectively movable between a first position in which the pump is in communication with the chamber 216 of the floatation member and a second position in which the chamber 216 of the floatation member is placed in communication with the atmosphere, for example, over a port 246. Hence, the valve is a three-way valve. With the valve in the second position, water can displace any air in floatation member due to the weight of a watercraft on the lift 10. That is, the downward force applied to the lift due to the weight of the watercraft will allow water to enter the floatation member through the ports 230. Air displaced by the ports will exit the floatation member through the valve port 246. Conversely, when the valve is in the first position, the pump can be operated to force air into the floatation member chamber 216. In this instance, the air entering the floatation member will displace water in the floatation member chamber, the water being forced out through the ports 230. The floatation member can be provided with channels 248 in the lower surface. As seen in FIGS. 15B and 19, there are longitudinal channels 248*a* which extend substantially the front-to-back length of the lower surface and a transverse generally U-shaped channel 248*b* which places the longitudinal channels in communication with the ports 230. The channels 248 facilitate the flow of water in the chamber toward the ports 230, and to help in further emptying of the chamber of water. Filling the floatation member with air will increase the buoyancy of the lift sufficiently to lift the back end of a watercraft placed on the lift out of the water. The floatation member can be emptied of air by turning the valve to the second position to allow the back of the watercraft to enter the water, when it is desired to use the watercraft. The pump 240 can be provided with electricity either through solar panels, a 12V power supply (i.e., from batteries), or from a 110V power supply (i.e., from an electrical a/c outlet). The pump could also be manually operated.

The pump 240 can be provided with an automatic control to facilitate the addition or removal air from the floatation member 200, such that the pump control unit will shut off when a predetermined pressure within the floatation member 200 is reached or when the lift section is level. For example, a mercury switch or the like can be used to open the circuit when the lift 10 is level.

As various changes could be made in the above constructions without departing from the scope of the claimed invention, it is intended that all matter contained in the above description or shown in the accompanying drawings shall be interpreted as illustrative and not in a limiting sense. For example, although the water port is positioned in the bottom surface of the floatation member 200, the water port could be formed in the side wall of the floatation member, in which case, it would preferably be proximate the bottom of the floatation member. The air port need not be positioned above the water port. These examples are merely illustrative.

The invention claimed is:

1. A floating dock system, comprising:

a first dock member including an upper surface, a bottom surface, and a side wall; at least one connector receiving socket formed in said side wall; said connector receiving socket comprising a socket main portion spaced inwardly from the side wall and a socket entrance portion extending from the side wall to said socket main portion; said socket main portion and said socket entrance portion both opening at the bottom of said dock member; said socket main portion having a side-to-side width greater than the side-to-side width of said entrance portion; said socket entrance portion being defined by side walls; said socket main portion being defined by a back wall, opposed side walls, and a front surface; said socket entrance portion opening into said front surface of said socket main portion; and a connecter; said connector comprising at least one post and a brace extending from said post; said post having a side-to-side width greater than the side-to-side width of said brace; said post being sized to be received in said connector socket main portion; said connector brace having a side-to-side width sized to extend through said connector socket entrance portion; whereby, when said connector is received in said socket, said connector post engages said front surface of said socket main portion to prevent said connector from being pulled horizontally from said connector receiving socket; wherein said at least one post comprises a generally convex midsection connected between a pair of generally falcate end portions, said falcate end portions being generally symmetrical about a vertical plane extending the length of said at least one post through the center of said at least one post.

2. The floating dock system of claim 1, wherein said at least one post is generally tapered.

3. The floating dock system of claim 1, wherein said at least one post is a first post; said connector further comprising a second post; said first and second posts being on opposite sides of said brace; said brace having a length, such that when said first post is received in said socket main portion, said second post is spaced from said wall of said first dock member, to facilitate connecting of a second dock member to said first dock member.

4. The floating dock system of claim 1, wherein said connector comprises an end wall on said brace; said end wall being opposite said post; said connector being adapted to have an accessory mounted to said end wall of said brace.

5. The floating dock system of claim 4 wherein said accessory is a guide post which is generally S-shaped, said guide post being pivotal relative to said connector.

6. The floating dock system of claim 1 including a second dock member; said second dock member including an upper surface, a bottom surface, and a side wall; at least one connector receiving socket formed in said side wall; said connector receiving socket comprising a socket first portion spaced inwardly from the side wall and a socket entrance portion extending from the wall to said socket first portion; said socket first portion and said socket entrance portion both opening at the bottom of said body; said socket first portion having a side-to-side width greater than the side-to-side width of said entrance portion; said connector receiving sockets of said first and second dock members being positioned on said walls of said first and second dock members, such that, when said first and second dock members are positioned adjacent each other, said connector receiving socket of said second dock member is aligned with the connector receiving socket of said first dock member.

7. The floating dock system of claim 6 wherein said second dock member is has a side-to-side width which is less than a side-to-side width of said first dock member.

8. A connector adapted connect members of a floating dock system; said connector comprising: at least one post and a brace extending from said post; said at least one post having a side-to-side width greater than the side-to-side width of said brace; wherein said at least one post comprises walls and a top surface that substantially covers an upper end of the post; said walls and the top surface defining a generally convex midsection connected between a pair of generally falcate end portions; said falcate end portions being generally symmetrical about a vertical plane extending the length of said at least one post through the center of said at least one post.

9. The connector of claim 8, wherein said at least one post is a first post; said connector further comprising a second post; said second post being shaped generally similarly to said first post; said first and second posts being positioned on opposite ends of said brace.

10. The connector of claim 8 wherein said brace has a generally rectangular prism shape.

11. The connector of claim 8 wherein said brace and said at least one post are of substantially the same height, such that said connector defines a generally flat upper surface.

12. The connector of claim 8 including a flange extending outwardly from a base of said at least one post and said brace.

13. A floatation system for a member of a floating dock system, the floatation system comprising:

a floatation member having body comprising a lower surface, an upper surface, and a side wall which in combination define a chamber;

at least one water port to place the chamber in communication with water when said floatation member is in use;

at least one connector socket in at least one wall of said body; said connector socket comprising a socket main portion spaced inwardly from the wall of the body and a socket entrance portion extending from the wall to said socket main portion; said socket main portion and said socket entrance portion both opening toward the bottom of said body; said socket main portion having a side-to-side width greater than the side-to-side width of said entrance portion; said socket entrance portion being defined by side walls; said socket main portion being defined by a back wall, opposed side walls, and a front surface; said socket entrance portion opening into said front surface of said socket main portion;

a lower slot beneath said connector receiving socket; said lower slot being defined by side walls and a back wall; said connector socket opening into said lower slot; said lower slot being opened to said body wall over the full width of said lower socket;

an air port in a surface of said body; and a pump in communication with said chamber; said pump being operable to deliver air into said chamber.

14. The floatation system of claim 13 wherein said connector socket is opened at said body upper surface.

15. The floatation system of claim 13 wherein the floatation member comprises channels formed in the lower surface of the chamber, the channels having one end in operative communication with at least one water port.

16. The floatation system of claim 13 wherein said body includes a positioner on said upper surface.

17. The floatation system of claim 13 wherein said air port is spaced above said at least one water port.

18. The floatation system of claim 17 wherein said water port is positioned in said lower surface of said body.

19. The floatation system of claim 18 wherein said water port is positioned in a depression in said lower surface; whereby, said water port is positioned below a plane of said lower surface.

20. The floatation system of claim 18 further including a valve positioned between said chamber and said pump; said valve being selectively positionable between a first position in which said pump is in communication with said chamber to urge air into said chamber, and a second position in which said chamber is placed in communication with the atmosphere.

21. The floatation system of claim 13 wherein said floatation member body includes a pair of spaced-apart ramp members extending rearwardly from the rear wall of said body.

* * * * *